US007320612B2

(12) United States Patent
Koga

(10) Patent No.: US 7,320,612 B2
(45) **Date of Patent: *Jan. 22, 2008**

(54) CARD CONNECTOR

(75) Inventor: Shinichi Koga, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/606,476

(22) Filed: Nov. 30, 2006

(65) Prior Publication Data

US 2007/0128916 A1 Jun. 7, 2007

(30) Foreign Application Priority Data

Dec. 1, 2005 (JP) ..... 2005-347722

(51) Int. Cl.
*H01R 13/62* (2006.01)

(52) U.S. Cl. ..... 439/159; 439/141

(58) Field of Classification Search ..... 439/140, 439/141, 159, 160

See application file for complete search history.

(56) References Cited

U.S. PATENT DOCUMENTS 5,161,989 A * 11/1992 Okubo et al. ..... 439/159
5,368,493 A * 11/1994 O'Brien et al. ..... 439/160
5,451,168 A * 9/1995 Shuey ..... 439/159
5,667,396 A * 9/1997 Pan et al. ..... 439/160
6,027,351 A 2/2000 Hashimoto
6,042,404 A * 3/2000 Lai et al. ..... 439/159
6,139,338 A * 10/2000 Hirai et al. ..... 439/141
6,203,378 B1 * 3/2001 Shobara et al. ..... 439/638
6,478,592 B1 * 11/2002 Hu et al. ..... 439/159
6,508,402 B1 1/2003 Takada et al.
6,719,589 B2 4/2004 Nishio et al.

FOREIGN PATENT DOCUMENTS

JP 11-026084 1/1999
JP 2000-251024 9/2000
JP 2003-086296 3/2003
JP 2005-116240 4/2005

* cited by examiner

*Primary Examiner*—Thanh-Tam Le
(74) *Attorney, Agent, or Firm*—Jordan and Hamburg LLP

(57) ABSTRACT

A card connector has a miniaturized and simplified structure. The card connector has a base frame includes side frames, a connector body provided at one end of the base frame and serving to arrange in a row and fix a plurality of contact pins, a shutter having through orifices corresponding to the plurality of contact pins arranged in a row and fixed by the connector body and can move in a state in which the contact pins are inserted into the through orifices, and a shutter lock formed by a segment lead of at least one side frame of the two side frames of the base frame, which locks the movement of the shutter before the card is inserted and releases the lock and allows the connection of contacts of the card with the contact pins in response to the insertion of a compatible card. The shutter lock spring is.

2 Claims, 5 Drawing Sheets

1
1a
1b
1d
1e
2
2a
2b
3
3a
11b
30
31

11a
11b
1c
B
1f
1e
20
A 11a
11b
1e
20
20a
20b
1b
10
1f
1c

CARD CONNECTOR

CROSS-REFERENCE TO RELATED APPLICATIONS

This application is based upon and claims the benefit of priority from the prior Japanese Patent Application No. 2005-347722, filed on Dec. 1, 2005, the entire contents of which are incorporated herein by reference.

BACKGROUND OF THE INVENTION

1. Field of the Invention

The present invention relates to a card connector, and more particularly to a card connector with improved lock mechanism for a shutter member that serves to protect contact pins.

2. Description of the Related Art

Systems employing card-type memory devices and using them as external memory devices of electronic apparatuses have become widely spread in recent years. In order to connect such card-type memory devices to electronic apparatuses, connectors adapted thereto are required.

A large number of types and systems of connectors for card-type memory devices (referred to hereinbelow as card connectors) have been developed and introduced (for example, see Japanese Patent Application Laid-open No. 2000-251024, FIG. 1, page 3, right column).

The card connector described in Japanese Patent Application Laid-open No. 2000-251024 has a configuration in which the side surface of the inserted card is suppressed and held by a suppression mechanism. However, with such connector, there is a risk of the inserted card being thrown out from the card holder under the effect of external impacts. For this reason, a shutter was provided for closing a card insertion port through which the card is inserted, and the card was prevented from being thrown out by closing the shutter. Therefore, with the connector of this type, a shutter has to be provided separately from the connector. As a result, miniaturization is difficult, the number of component increases, and production cost rises significantly.

A connector in which the shutter was omitted to overcome the above-described drawbacks is also known (for example, see Japanese Patent Application Laid-open No. 2003-86296, FIG. 2, Par. No. 0015 to 0021).

The card connector described in Japanese Patent Application Laid-open No. 2003-86296 has a configuration comprising a housing that forms an insertion section for inserting a card, contact terminals (contact pins) formed inside the housing in a condition of extending in the insertion direction so as to come into contact with the terminals (contacts) of the card, and a lock mechanism for engaging with concave sections located on the side surfaces of the card and locking the card in a predetermined mounting position when the card is inserted into the insertion section and comes close to the mounting position.

With such connector structure, the card inserted into the mounting position of the housing can be prevented from falling out or being pulled out and the card can be locked on reaching the mounting position of the housing. Therefore, no load is applied to the car in the card insertion process, the insertion operation can be performed smoothly, the card can be prevented from being damaged by the lock mechanism, and it is not necessary to provide a special shutter mechanism.

Furthermore, when a card is removed from the card connector, the end section of the card is usually picked by fingers and pulled out, but when the contact is strong, the card cannot be easily pulled out. Moreover, the card is difficult to pull out because the card insertion port is narrow. Accordingly, a connector has been suggested that is provided integrally with an eject mechanism that facilitates the discharge of a card (for example, see Japanese Patent Application Laid-open No. H11-26084, FIG. 1, Par. No. 0019 to 0020, 30).

The card connector described in Japanese Patent Application Laid-open No. H11-26084 has a configuration comprising an eject mechanism having a cam member in one side section of a housing and comprising an elastic engagement member that engages with a linear side edge of a card discharged by the cam member in the other side section of the housing and regulates the movement of the card in the discharge direction. With such configuration, when the accommodated card is discharged by the eject mechanism having the cam member, the card can be prevented from falling down and the card can be easily removed by hand.

However, although some of the cards of various types, for example, compact flash (registered trade name) memory cards, smart media cards, memory sticks, and PC cards are regulated by standards, a standard that has unified all the cards has not yet been established. For this reason, the cards of various types differ in dimensions and shapes and accordingly the card connectors have structures suitable for respective cards.

As a result, a user of an electronic apparatus sometimes erroneously inserts a small card into a large card insertion port. If an incompatible card is inserted erroneously into an insertion port, the contact pins of the connector can be deformed or broken. Furthermore, even if the card is of the same size as the insertion port, the card is sometimes inserted upside down or back to front. Such reverse insertion also can cause a similar damage. Furthermore, dust or dirt easily adheres to the contact pins of the connector, thereby causing poor contact.

Furthermore, in the connector described in Japanese Patent Application Laid-open No. 2000-251024, the inserted card cannot be held reliably, a shutter has to be provided in the card insertion port to prevent the card from being thrown out, and the shutter has to be provided separately from the connector. The connector described in Japanese Patent Application Laid-open No. 2003-86296 has no shutter, comprises a lock mechanism and prevents the card inserted into the mounting position of the housing from falling out or being pulled out, but it does not resolve all the aforementioned problems encountered when the card connector is disposed in photo printing automatic vending machines or the like. Furthermore, those problems are not resolved with the connector described in Japanese Patent Application Laid-open No. 11-26084.

In order to resolve the aforementioned problems, the applicant suggested an invention the objects of which were to provide a card connector comprising a mechanism capable of preventing the contact pins from being bent or damaged even when a card of different size is inserted by mistake and to provide a card connector equipped with an eject mechanism for easily discharging the inserted card (Japanese Patent Application Laid-open No. 2005-116240).

The card connector according to the invention conceived by the applicant and described in Japanese Patent Application Laid-open No. 2005-116240 has a structure comprising a connector body accommodating a plurality of contact pins, a shutter member that is movably mounted on the connector body, covers the distal end sections of the contact pins and protects them from the outside, and a pair of side frames having lock mechanisms that lock the movement of the shutter member before the card is inserted, release the lock in response to the insertion of the compatible card, and allow the connection of the card contacts with the distal end sections of the contact pins of the connector body.

Furthermore, the pair of side frames are detachably mounted on both side walls of the connector body, and the lock mechanism is provided on each of the pair of side frames. The lock mechanism is a lock spring member such that the insertion of a card causes the release of the shutter member, and the removal of the card restores the state of engagement with the shutter member.

Therefore, this card connector that has been heretofore suggested by the applicant has a configuration in which a pair of side frames are detachably mounted on both side walls of the connector body, and lock mechanism are provided on the pair of side frames.

Due to the presence of side frames provided detachably in the transverse direction, this configuration is inconvenient from the standpoint of card connector miniaturization. Furthermore, in this structure, the lock mechanisms are provided on the side frames.

Therefore, this invention that has heretofore been suggested by the applicant, was also insufficient from the standpoint of card connector miniaturization and had to involve a complex structure.

SUMMARY OF THE INVENTION

Accordingly, an object of the present invention is to provide a card connector that realizes better miniaturized and simple structure.

In accordance with the first aspect of the present invention that attains the aforementioned object, there is provided a card connector comprising: a base frame having side frames formed by bending at both sides thereof, a connector body provided at an end side of the base frame opposite the side where a card is inserted and serving to arrange in a row and fix a plurality of contact pins, a shutter member that has through orifices corresponding to the plurality of contact pins that are arranged in a row and fixed by the connector body and can move in a state in which the contact pins are inserted into the through orifices, and a shutter lock mechanism that locks the movement of the shutter member before the card is inserted, releases the lock in response to the insertion of a compatible card, and allows the connection of contacts of the card with the contact pins, wherein the shutter lock mechanism is formed by a segment lead of at least one side frame of the two side frames of the base frame.

As a second aspect, in the shutter lock mechanism, a protrusion facing inward of the side frame is formed in a distal end section and in an intermediate section of the segment lead, and when a card is not inserted, the protrusion of the distal end section of the segment lead and a hook section of the shutter member are engaged to fix the movement of the shutter member, and when the card is inserted, the card end abuts against the protrusion of the intermediate section of the segment lead, and the segment lead is pushed outwardly, so that the engagement of the protrusion of the distal end section of the segment lead and the hook section of the shutter member is released.

As a third aspect, in the card connector of the second aspect, when the protrusion of the distal end section of the segment lead and the hook section of the shutter member are in an engaged state, the shutter member is in a position in which the distal end section of the plurality of contact pins are accommodated in the through orifices by a spring, and following the insertion of the card against the elastic pressure of the spring, the distal end sections of the contact pins are exposed from the through orifices to allow the connection with the contacts of the card, and when the card is pulled out, the shutter member returns to the state in which the protrusion of the distal end section of the segment lid is engaged with the hook section of the shutter member under the effect of the spring.

Furthermore, as a forth aspect, the card connector of any of the above-described aspects further comprises a hook section formed in the central section in the lengthwise direction of the shutter member, a slidable push bar provided at the side frame, and a rotary arm in which one end is engaged with the push bar and the other end is engaged with the hook section formed in the central section of the shutter member, and when the card is pulled out in a state where the contacts of the inserted card and the contact pins are connected, a pushing pressure is applied by the push bar to one end of the rotary arm, a pushing pressure in an opposite direction is applied to the other end of the rotary arm, and a force is applied to the card in a pulling direction via the shutter member.

In accordance with the present invention, the shutter lock spring is formed by a segment lead of at least one side frame of the two side frames of the frame body. Therefore, it is not necessary to provide side frames that are detachably mounted on both side walls of the body or provide separately a lock mechanism of the shutter member. As a result, the card connector is miniaturized and the structure thereof is simplified.

DESCRIPTION OF THE PREFERRED EMBODIMENTS

Embodiments of the present invention will be described hereinbelow with reference to the appended drawings. The embodiments merely illustrate the present invention and place no limitation on the application of the present invention.

Figure 1B:
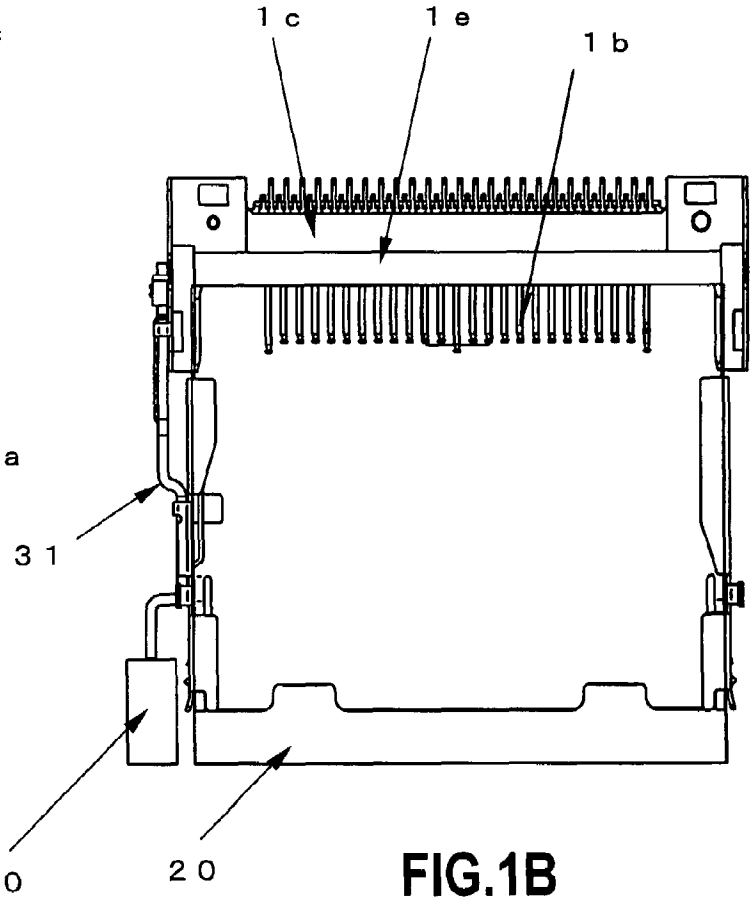
FIGS. 1A and 1B are plan views illustrating an embodiment of the card connector in accordance with the present invention.
Figure 1A:
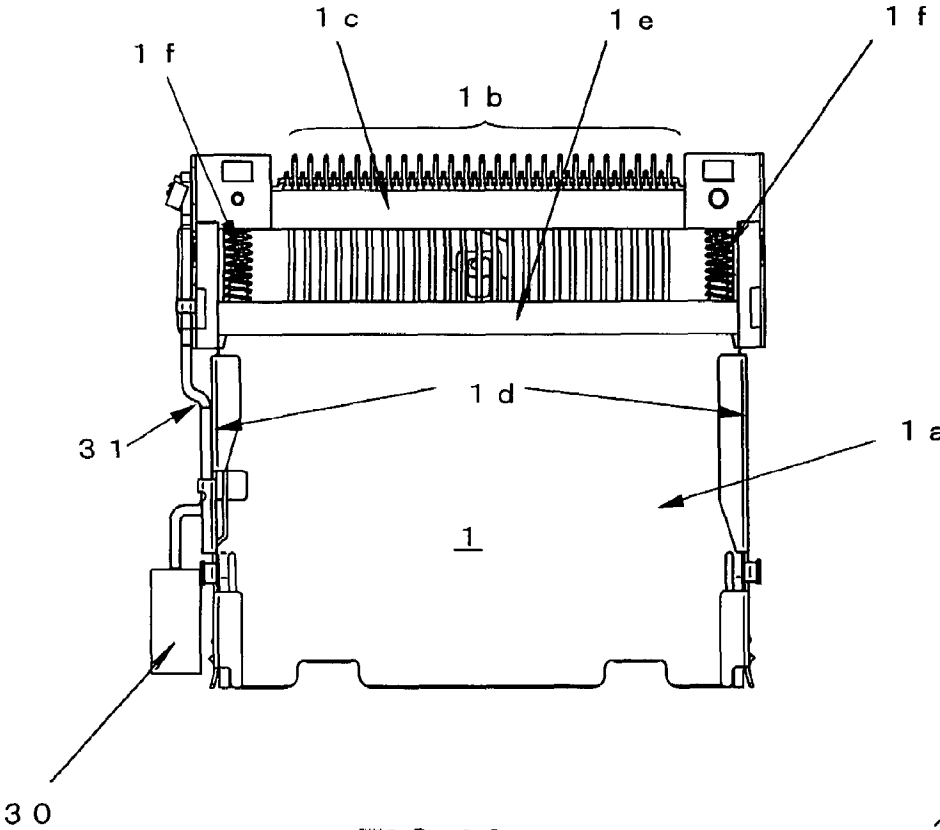

FIGS. 1A and 1B are plan views illustrating an embodiment of the card connector in accordance with the present invention. FIG. 1A shows the state in which a card is not inserted. By contrast, FIG. 1B shows the state after the card has been inserted.

A card connector 1 in accordance with the present invention has a base frame 1*a* in the form of a metal plate. Two side frames 1*d* are formed by U-shape bending at both sides of the base frame 1*a*. The card to be inserted can be held by fingers by the U-shaped bent sections of the two side frames 1*d*.

The card connector has a connector body 1*c* formed from an insulating block such as a resin block for arranging in a row and fixing a plurality of contact pins 1*b* on the side of the base frame 1*a* opposite the side where the card is to be inserted. Furthermore, a shutter member 1*e* is provided for covering the distal end sections of the plurality of contact pins 1*b* that are arranged in a row and fixed by the connector body 1*c* and protecting them from the outside.

Here, the explanation will be further continued with reference to FIGS. 2A through 2D explaining the surface of the card connector 1 on the opposite side from the surface shown in FIG. 1. FIG. 1A shows the state before the card 20 is inserted, in which the distal end sections of the contact pins 1*b* are covered and protected by the shutter member 1*e*.

Figures 2A, 2B, 2C, 2D:
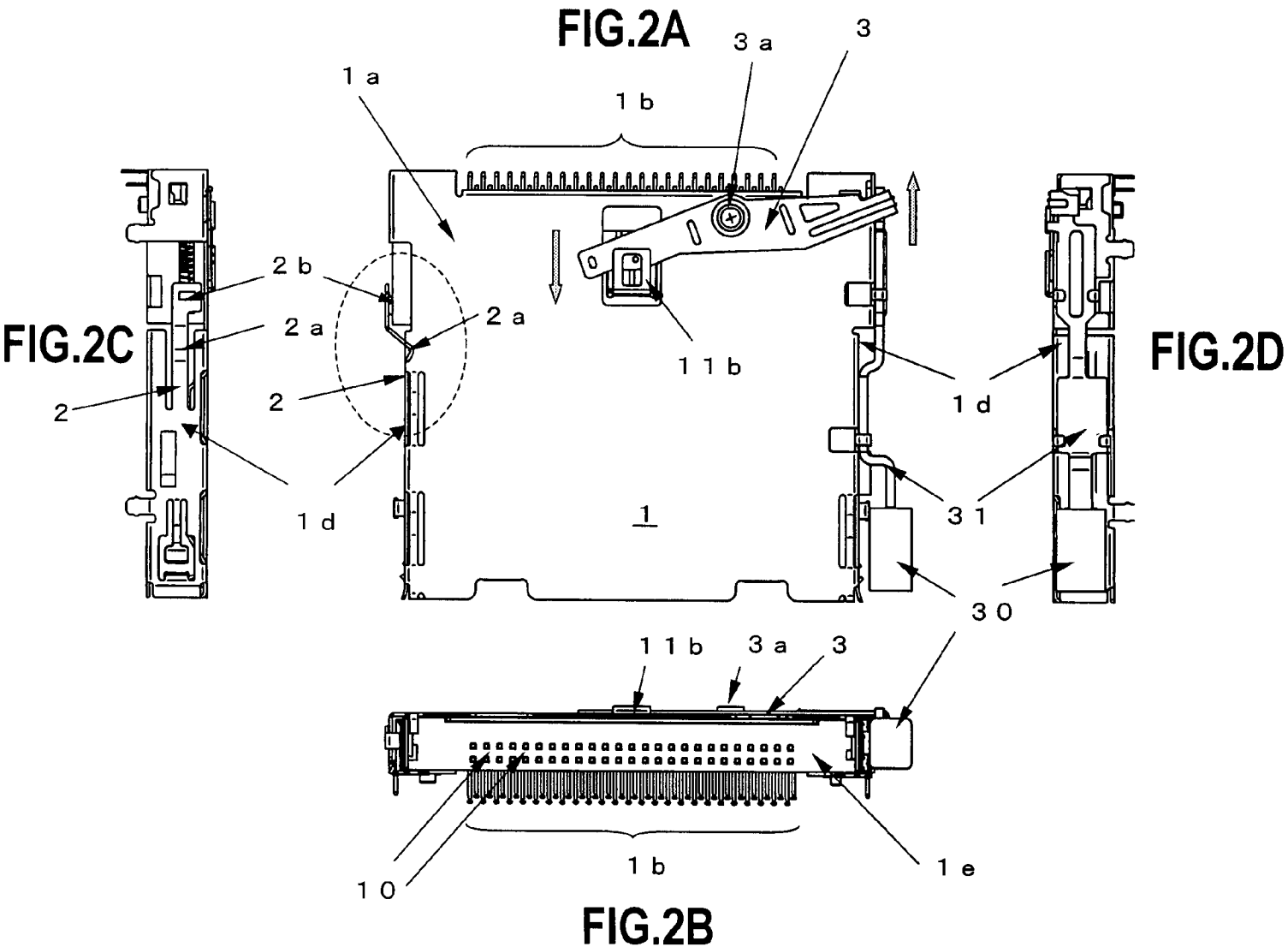
FIGS. 2A through 2D show views illustrating the surface of the card connector on the side opposite that of the surface shown in FIG. 1.

FIGS. 2 2A through 2D explain the surface opposite that shown in FIG. 1. FIG. 2A is a plan view, FIG. 2B is a front view, and FIG. 2C and FIG. 2D are left and right side views.

As clearly shown in FIG. 2B, the shutter member 1*e* has through orifices 10 corresponding to the plurality of contact pins 1*b*. When the card 20 is not inserted, as shown in FIG. 1A, the shutter member 1*e* is positioned at the distal end sections of the contact pins 1*b* by an elastic pressure of a coil spring 1*f* inserted between the connector body 1*c* and shutter member 1*e*. In this state, the distal end sections of the contact pins 1*b* are protected.

When the card 20 is inserted, as shown in FIG. 1B, the shutter member 1*e* is pushed toward the connector body 1*c* by the end section of the card 20 against the elastic pressure of the coil spring 1*f*. As a result, the distal end sections of the contact pings 1*b* are pushed into the through orifices 10 of the shutter member 1*e* and inserted into the contacts on the side of the card 20, thereby enabling the electric connection of the contact pins 1*b* and contacts of the card 20.

To facilitate the understanding, FIG. 1B shows transparently a state in which the distal end sections of the contact pins 1*b* are inserted and connected to the contacts on the card.

To facilitate further the understanding of the present invention, this configuration will be further explained with reference to FIGS. 3A, 3B and FIGS. 4A, 4B that show the state where the base frame 1*a* and two side frames 1*d* are removed.

Figures 3A, 3B:
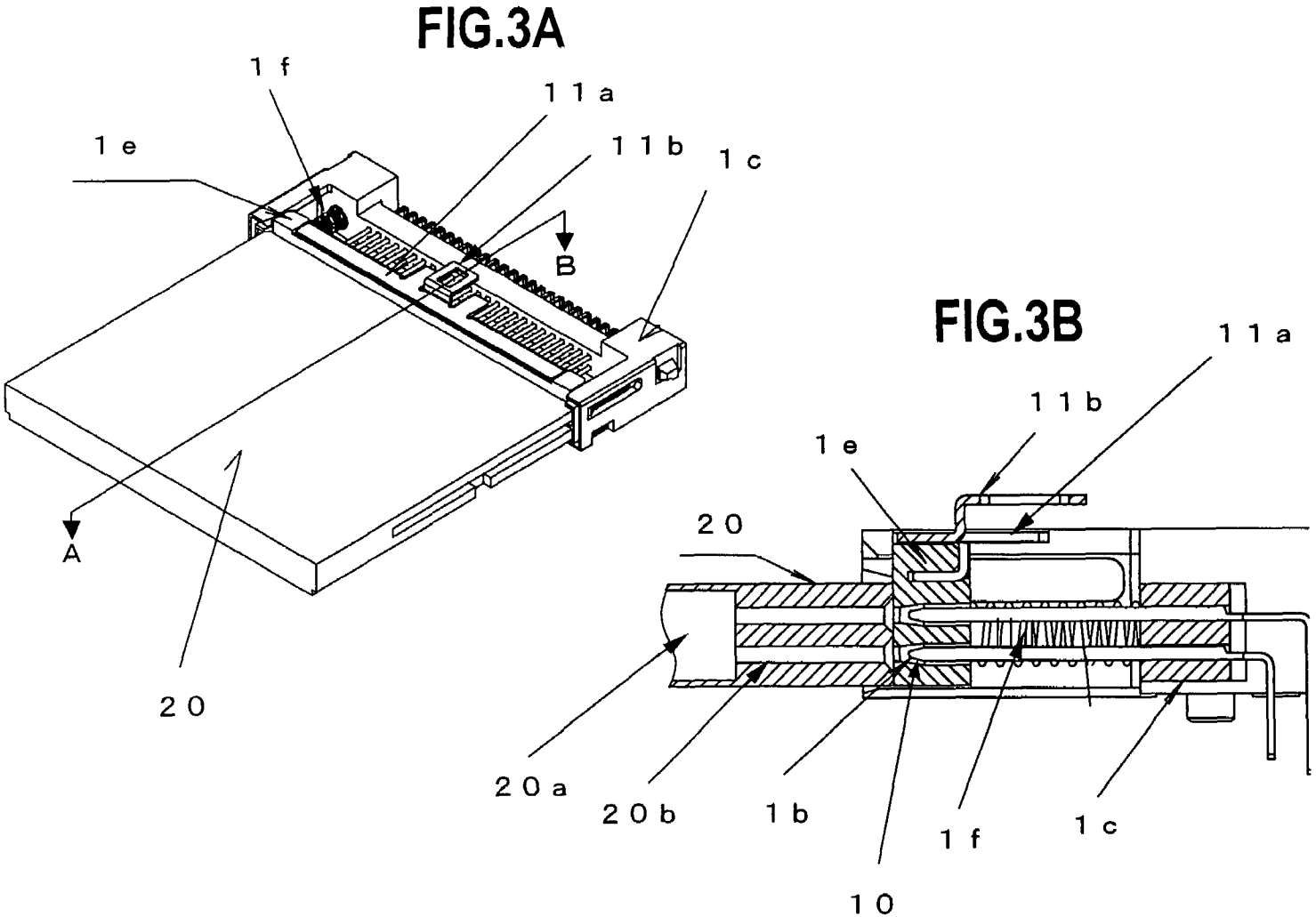
FIGS. 3A and 3B show views explaining a state before the card 20 is connected to the contact pins 1*b;*

FIGS. 3A and 3B show a state before the card 20 is connected to the contact pins 1*b*. FIG. 3A is a perspective view of the state after the base frame 1*a* and two side frames 1*d* have been removed. FIG. 3B is a cross-sectional view of the portion of the connector body 1*c* along the A-B line.

When the card 20 is not inserted, the shutter member 1*e* is pushed out by the coil spring 1*f* located between the shutter member and the connector body 1*c* and assumes a state in which the distal end sections of the contact pins 1*b* that have been arranged in a row and fixed by the connector body 1*c* are accommodated in the through orifices 10. As a result, the distal end sections of the contact pins 1*b* are protected.

The card 20 has a circuit component accommodation section 20*a* and female-type contacts 20*b* linked thereto.

Here, returning to FIG. 2A through 2D, a lock function of the shutter member 1*e*, which is a specific feature of the present invention, will be considered. Thus, as shown in FIG. 3B, when the card 20 is not inserted, the shutter member 1*e* assumes a state in which the distal end sections of the contact pins 1*b* are accommodated in the through orifices 10 by the coil spring 1*f*.

In the case where the distal end sections of the contact pins 1*b* are easily exposed if a pushing pressure is applied to the shutter member 1*e* against the elastic pressure of the coil spring 1*f*, the protection of contact pins 1*b* cannot be expected.

For this reason, in the invention suggested in the prior application filed by the applicant (Japanese Patent Application Laid-open No. 2005-116240), a structure was used in which a pair of side frames are detachably mounted on both side walls of the connector body, and a lock mechanism was provided on this pair of side frames. Furthermore, the lock mechanism was configured of a lock spring member that was deformed when the card was inserted, thereby causing disengagement from the shutter member, and, conversely, the state of engagement with the shutter member was restored when the card was removed.

With such structure, as has already been explained hereinabove, the width of the connector body was unavoidably increased because a pair of side frames was provided on both side walls of the connector body. Furthermore, since a lock spring member was provided on the side frames, the structure unavoidably became complex.

Accordingly, the present invention was created with the foregoing in view, and a specific feature thereof is that the lock mechanism is configured of a segment lead 2 formed in the two side frames 1*d* of the base frame 1*a*, as shown in FIG. 2A.

Thus, a segment lead 2 is formed in at least one of the two side frames 1*d*. In the example shown in FIG. 2, the segment lead is formed in the left side frame 1*d*.

The segment lead 2 can be formed at the same time as the side frame 1*d* is press formed. Therefore, by linking one end of the segment lead 2 to the side frame 1*d* and leaving the other end as a free end, elasticity is provided due to the rigidity of the side frame 1*d* itself.

Figure 5B:
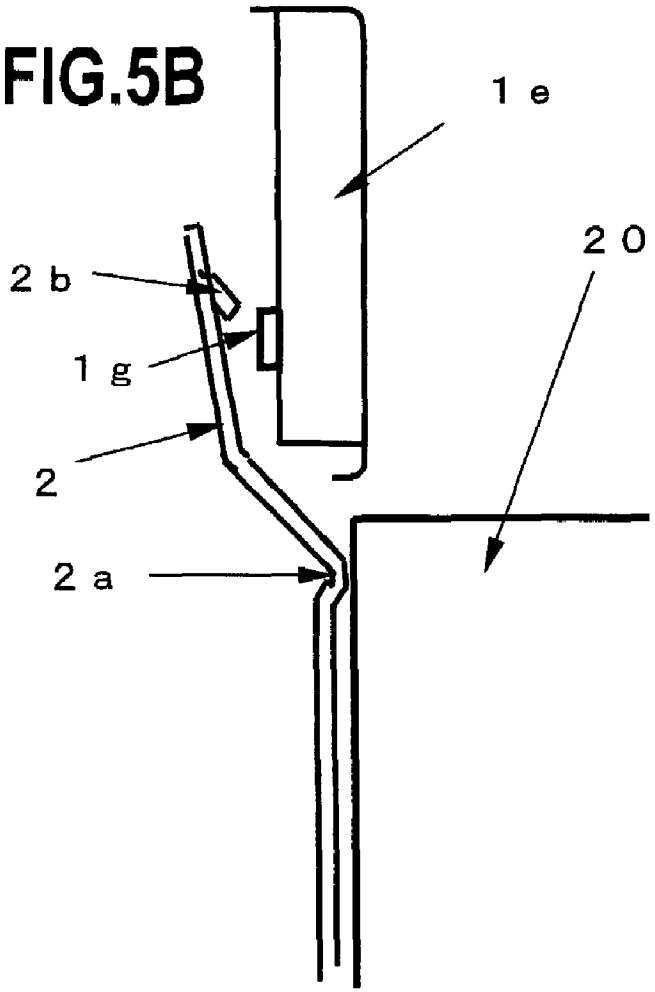
FIGS. 5A and 5B are cross-sectional views illustrating the shape of the segment lead 2.
Figure 5A:
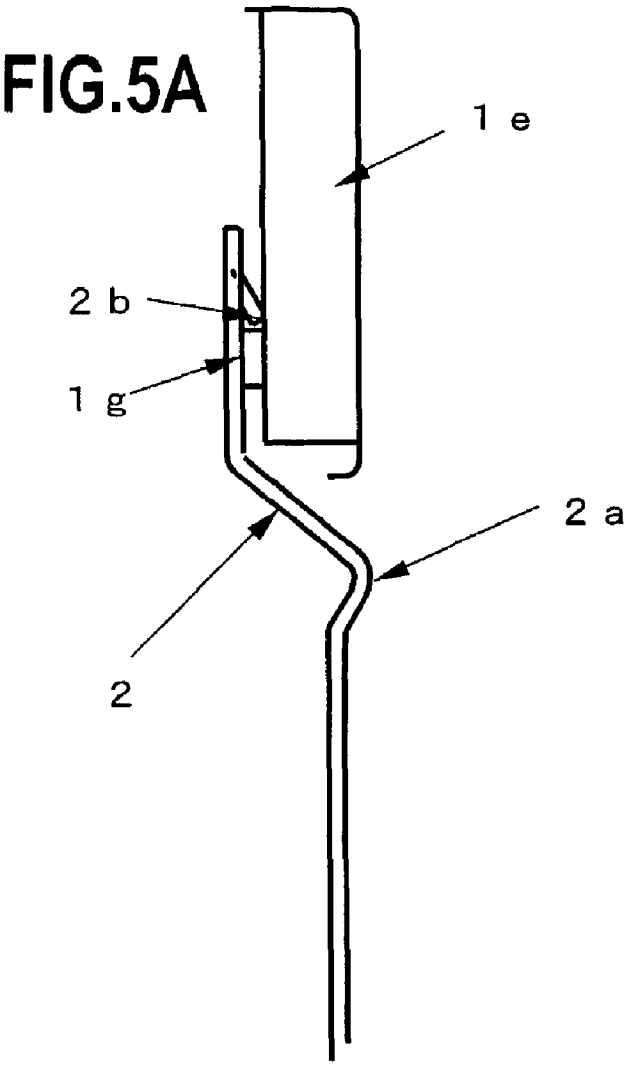

The segment lead 2, as shown by a cross-sectional view thereof in FIGS. 5A and 5B, is molded by bending so that it has respective protrusions 2*a*, 2*b* in the central section and distal end section.

FIG. 5A shows a state in which the card 20 is not inserted. FIG. 5B shows a state in which the card 20 is inserted into the card connector and pulled out therefrom.

Referring to FIG. 5A, as has already been explained, when the card 20 is not inserted, the shutter member 1*e* is in a position of protecting the distal end sections of the contact pins 1*b* due to the action of the coil spring 1*f* (see FIG. 3B).

At this time, as shown in FIG. 5A, since the elasticity of the segment lead 2 creates a returning force acting in the direction inward of the side frame 1*d* (rightward in FIG. 5A), the protrusion 2*b* at the distal end section of the segment lead 2 and a hook section 1*g* formed in the side section of the shutter member 1*e* are engaged.

As a result, the state in which the shutter member 1*e* protects the distal end sections of the contact pins 1*b* (FIG. 3B) is maintained, even if a pushing pressure is applied to the shutter member 1*e*.

On the other hand, if a state is assumed in which the card 20 is inserted, as shown in FIG. 5B, then the side section at the distal end of the card 20 will apply an outward push-out force to the protrusion 2*a* located in the intermediate section of the segment lead 2.

As a result, the segment lead 2 will be deformed and the engagement of the protrusion 2*b* at the distal end section and the hook section 1*g* of the shutter member 1*e* will be released. Then, the card 20 can be further inserted into the card connector 1.

Figures 4A, 4B:
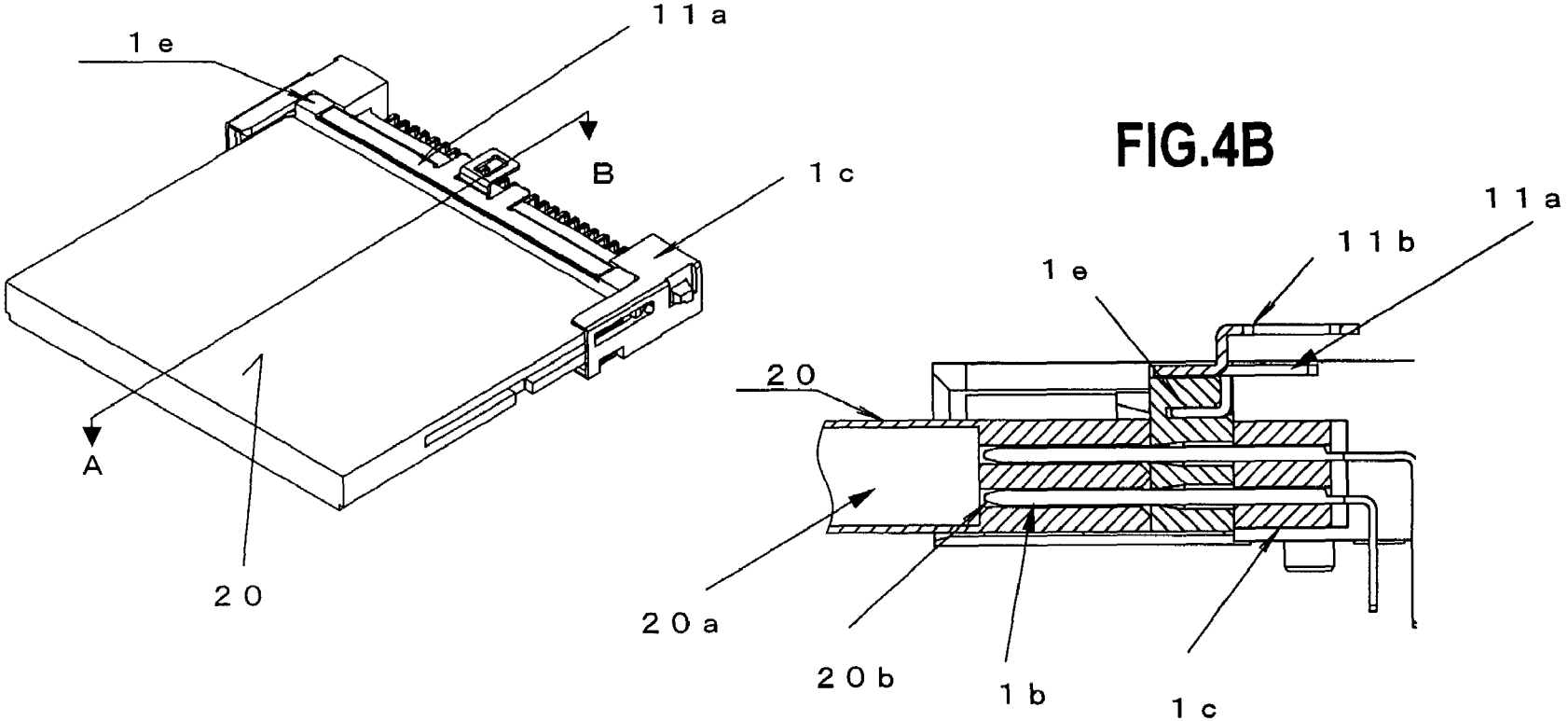
FIGS. 4A and 4B show views explaining a state in which the card is completely inserted into the card connector and the card 20 is connected to the contact pin 1*b*.

FIGS. 4A and 4B show a state in which the card 20 is completely inserted into the card connector 1, and the card 20 is connected to the contact pins 1*b*. FIG. 4A is a perspective view illustrating the state in which the base frame 1*a* and both side frames 1*d* are removed, and FIG. 4B is a cross-sectional view of the portion of the connector body 1*c* along the A-B line.

Due to the insertion of the card 20, the shutter member 1*e* is pushed back toward the connector body 1*c* against the elastic force of the coil spring 1*f*. As a result, the distal end sections of the contact pins 1*b* are exposed from the through orifices 10 of the shutter member 1*e* and inserted into the female-type contacts 20*b* of the card 20, thereby producing a state of electric connection to the circuits inside the circuit component accommodation section 20*a* of the card 20.

Referring to FIG. 5B, when the contacts of the card 20 are pulled out from the card connector, the contact of the side section of the card 20 and the protrusion 2*a* of the intermediate section of the segment lead 2 is released and the segment lead 2 is returned by the elasticity thereof into the state shown in FIG. 5A. At this time, the shutter member 1*e* is pushed out by the coil spring if, whereby the hook section 1*g* at the side section of the shutter member 1*e* and the protrusion 2*b* of the distal end section of the segment lead 2 are re-engaged and the state shown in FIG. 5A is maintained.

Here, when a card 20 is pulled out from the card connector in a state where the distal end sections of the contact pins 1*b* and the female-shaped contacts 20*b* of the card 20 are connected, a pull-out force has to be provided against a physical contact pressure created by the elasticity of the contacts 20*b* and contact pins 1*b*.

Therefore, an eject mechanism for easily pulling out the card 20 from the card connector 1 will be explained below. This eject mechanism can be employed as the preferred embodiment together will the specific features of the lock mechanism in accordance with the present invention that were explained above.

Returning to FIGS. 2A through 2D, a rotary arm 3 that can rotate about a support shaft 3*a* is provided on the rear surface of the base frame 1*a*.

On the other hand, a hook section 11*b* is provided in the central section of a metal sheet 11*a* integrally attached to the resin block of the shutter member 1*e*.

One end of the rotary arm 3 is engaged with the hook section 11*b* formed in the central section of the metal sheet 11*a*.

On the other hand, a push bar 31 having a pushbutton 30 at the distal end thereof is slidably provided at one side of the two side frames 1*d*. The other end of the push bar 31 is engaged with the other end of the rotary arm 3.

If the pushbutton 30 is pushed in the direction of the contact pins 1*b* shown in FIG. 2 after the card 20 has been inserted into the card connector 1, one end of the rotary arm 3 will be pushed up by the push bar 31 engaged therewith in the direction of the upward solid arrow about the support shaft 3*a* as a center. As a result, the other end of the rotary arm 3 will be pushed down in the direction of the downward solid arrow about the support shaft 3*a* as a center.

Because the other end of the rotary arm 3 is engaged with the hook section 11*b* located in the central section of the metal sheet 11*a* that is integrally attached to the resin block of the shutter member 1*e*, a force is provided that easily pushes the shutter member 1*e* out in the direction opposite that of the connector body 1*c* due to the lever effect.

As a result, the connection of the contacts 20*b* of the card 20 and the distal end sections of the contact pins 1*b* is released, and the card 20 can be easily pulled out by fingers.

The foregoing description of the embodiments is not intended to limit the invention to the particular details of the examples illustrated. Any suitable modification and equivalents may be resorted to the scope of the invention. All features and advantages of the invention which fall within the scope of the invention are covered by the appended claims.

What is claimed is:

1. A card connector comprising:

a base frame having side frames formed by bending at both sides thereof;

a connector body provided at an end side of said base frame opposite a side where a card is inserted and serving to arrange in a row and fix a plurality of contact pins;

a shutter member that has through orifices corresponding to the plurality of contact pins that are arranged in a row and fixed by said connector body and can move in a state in which said contact pins are inserted into said through orifices;

a shutter lock mechanism that locks the movement of said shutter member before said card is inserted, releases said lock in response to the insertion of a compatible card, and allows the connection of contacts of said card with said contact pins;

a hook section formed in the central section in the lengthwise direction of said shutter member;

a slidable push bar provided on at least one of said side frames; and a rotary arm in which one end is engaged with said push bar and the other end is engaged with the hook section formed in the central section of said shutter member;

wherein said shutter lock mechanism being formed by a segment lead on at least one of the two side frames of said base frame, the segment lead having a protrusion on a distal section facing inward with respect to the base frame and a protrusion on an intermediate section facing inward with respect to the base frame, a proximal end of the segment lead being substantially straight; and when said card is pulled out in a state where the contacts of said inserted card and said contact pins are connected, a pushing pressure is applied by said push bar to one end of said rotary arm, a pushing pressure in an opposite direction is applied to the other end of said rotary arm, and a force is applied to said card in a pulling direction via said shutter member.

2. A card connector comprising:

a base frame having side frames formed by bending at both sides thereof;

a connector body provided at an end side of said base frame opposite a side where a card is inserted and serving to arrange in a row and fix a plurality of contact pins;

a shutter member that has through orifices corresponding to the plurality of contact pins that are arranged in a row and fixed by said connector body and can move in a state in which said contact pins are inserted into said through orifices;

a shutter lock mechanism that locks the movement of said shutter member before said card is inserted, releases said lock in response to the insertion of a compatible card, and allows the connection of contacts of said card with said contact pins;

a hook section formed in the central section in the lengthwise direction of said shutter member;

a slidable push bar provided on at least one of said side frames; and a rotary arm in which one end is engaged with said push bar and the other end is engaged with the hook section formed in the central section of said shutter member;

wherein said shutter lock mechanism being formed by a segment lead on at least one of the two side frames of said base frame, the segment lead having a protrusion on a distal section facing inward with respect to the base frame and a protrusion on an intermediate section facing inward with respect to the base frame, a proximal end of the segment lead being substantially straight;

when the card is not inserted, the protrusion of the distal end section of said segment lead and a hook section of the shutter member are engaged to fix the movement of said shutter member;

when said card is inserted, the card end abuts against the protrusion of the intermediate section of said segment lead, and said segment lead is pushed outwardly, so that the engagement of the protrusion of the distal end section of said segment lead and the hook section of the shutter member is released;

when the protrusion of the distal end section of the segment lead and the hook section of said shutter member are in an engaged state, the shutter member is in a position in which distal end sections of said plurality of contact pins are accommodated in said through orifices by a spring;

following the insertion of said card against the elastic pressure of said spring, the distal end sections of said contact pins are exposed from said through orifices to allow the connection with the contacts of said card;

when said card is pulled out, said shutter member returns to the state in which the protrusion of the distal end section of said segment lead is engaged with the hook section of said shutter member under the effect of said spring; and when said card is pulled out in a state where the contacts of said inserted card and said contact pins are connected, a pushing pressure is applied by said push bar to one end of said rotary arm, a pushing pressure in an opposite direction is applied to the other end of said rotary arm, and a force is applied to said card in a pulling direction via said shutter member.

* * * * *